US006162067A

United States Patent [19]

Haga

[11] Patent Number: 6,162,067

[45] Date of Patent: Dec. 19, 2000

[54] COIL-BOBBIN FOR AC ADAPTER

[75] Inventor: Yuji Haga, Saitama, Japan

[73] Assignee: Tamura Corporation, Tokyo, Japan

[21] Appl. No.: 09/491,130

[22] Filed: Jan. 26, 2000

[30] Foreign Application Priority Data

Oct. 2, 1999 [JP] Japan ..... 11-032537

[51] Int. Cl.[7] ..... H01R 12/00

[52] U.S. Cl. ..... 439/76.1; 363/146; 336/192; 336/198

[58] Field of Search ..... 439/76.1, 638; 363/146; 336/192, 198

[56] References Cited

U.S. PATENT DOCUMENTS

| | | | |
|---|---|---|---|
| 3,663,914 | 5/1972 | Lane | 336/192 |
| 3,928,831 | 12/1975 | Yatsushiro et al. | 336/192 |
| 4,273,406 | 6/1981 | Okagami | 439/76.1 |
| 5,200,731 | 4/1993 | Tochio et al. | 336/98 |

FOREIGN PATENT DOCUMENTS

| | | |
|---|---|---|
| 06251960 | 9/1994 | Japan . |
| 08182324 | 12/1996 | Japan . |
| 07220935 | 2/1997 | Japan . |
| 09045552 | 2/1997 | Japan . |

*Primary Examiner*—Brian Sircus
*Assistant Examiner*—Son Nguyen
*Attorney, Agent, or Firm*—Dennis G. LaPointe; Mason & Assoc., P.A.

[57] ABSTRACT

A coil bobbin for an AC adapter provides two flanges to be formed at both ends thereof, having coils wound between these flanges, and an incorporated core. At a lower portion of one flange, a unit to fit a rectifying circuit configured by electronic components is provided. A mounting apparatus is configured so that it is selectable whether electronic components are directly attached to a lower portion of a flange, or a substrate on which electronic components are mounted is attached.

4 Claims, 5 Drawing Sheets

PRIOR ART

COIL-BOBBIN FOR AC ADAPTER

BACKGROUND OF THE INVENTION

1. Field of the Invention

This invention relates to a coil bobbin used for an AC adapter converting alternate currents into direct currents.

2. Description of Related Art

Equipment to be used domestically such as a tape recorder, etc. can be operated by a dry batteries, and certain types of dry batteries are provided with an AC adapter as an accessory so that commercial power supplies may be used as a driving source.

FIG. 7 shows a certain example of circuits as being conventionally used for the above described AC adapter. This AC adapter circuit comprises a pair of input terminals T1 and T2. These input terminals T1 and T2 are configured in particular by a pair of AC blades.

The input terminals T1 and T2 are connected to a coil C1 on a primary side of a transformer T, and an alternating voltage is applied, and mutual induction action generates a predetermined alternating voltage at a coil C2 on a secondary side of the transformer T, and this alternating voltage is rectified from alternating current into direct current via a rectifying circuit configured by a bridge circuit of a diode 12 and a smoothing capacitor 13, etc. and converted into a predetermined direct voltage. This direct-current voltage is supplied to an electronic apparatus (not shown), such as a tape recorder, etc. via a detachable plug 28 having a known configuration.

An AC adapter, as shown in FIG. 8 is provided with, a coil bobbin 1' which is wound by the coils C1 and C2 and into which a core 9 is incorporated. One end side of this coil bobbin 1' is provided with an AC blade 10, and the other end side thereof is provided with a substrate 15. Electronic parts 14 such as a diode 12, and a smoothing capacitor 13, etc. are mounted on this substrate 15. These assembly bodies are accommodated in a case comprising a appropriately-shaped lower case 29, and a box-type upper case 30, etc.

Thus, in such a conventional AC adapter, the coil bobbin 1' is a type to be attached to the substrate, and has drawbacks that the electronic parts 14 cannot be directly incorporated into the coil bobbin 1', and that components are abundant in number.

SUMMARY OF THE INVENTION

This invention is proposed by contemplating the above-described contents. The object of the present invention is to use a coil bobbin for AC adapter as a coil bobbin of a type to be mounted on a substrate for an AC adapter, and to directly attach electronic components to the coil bobbin without using any substrate. In case of the latter specification, any substrate will become unnecessary, resulting in making a coil bobbin for an AC adapter obtainable so that the number of components can be reduced and miniaturization can be accomplished.

DETAILED DESCRIPTION OF THE INVENTION

Figure 1:
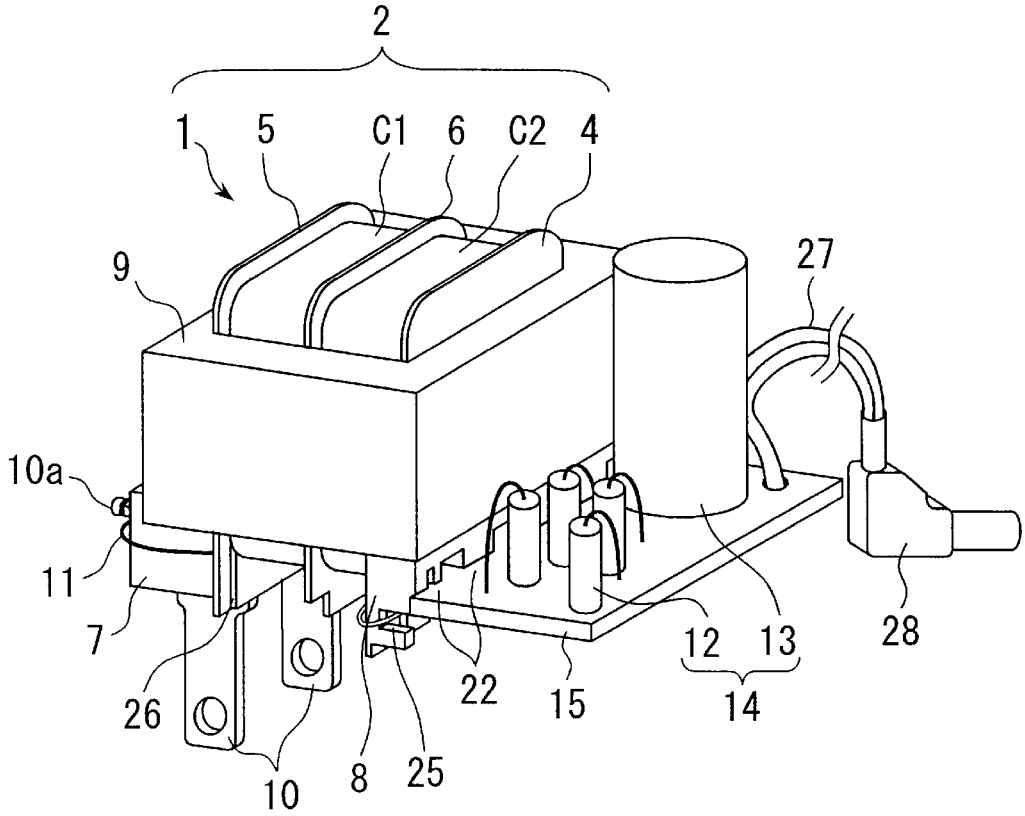
FIG. 1 is a perspective view showing a case where an AC adapter of a type to be mounted onto a substrate is assembled by using a coil bobbin according to an embodiment of the present invention.

As shown in FIG. 1 through FIG. 5, a coil bobbin 1 of the present invention configured by molding an insulating resin comprises a hollow winding drum portion 3, flanges 4 and 5 formed at both ends of the hollow winding drum portion 3 respectively, an intermediate flange 6 acting as a separation wall formed between those flanges 4 and 5, and a thick portion formed below the flange 4 at one end. In addition, the coil bobbin 1 comprises a substrate or electronic-components attaching portion 8 having substrate attaching grooves 22 as well as electronic-components attaching cavities 16, and an AC blade attaching portion 7 comprising a thick portion having been formed below the other flange 5 at the opposite side.

A primary coil C1 and a secondary coil C2 are respectively wound, as shown in FIG. 1, on and around the winding drum portion 3 with the intermediate flange 6 splitting them. A core 9 in the E-I type or the E-E type is integrated into the coil bobbin 1. In addition, the base portion of an AC blade 10 is attached to an AC blade attaching portion 7. A leader line 11 of the primary coil C1 is connected to a leader line connecting portion 10*a* of the AC blade 10 which is disposed to outward project above this AC blade 10. To the substrate or electronic components attaching portion 8 disposed opposite to this, a substrate 15 is attached onto which electronic components 14 such as a diode 12 and a capacitor 13, etc. are mounted under the condition shown in FIG. 1.

Figure 2:
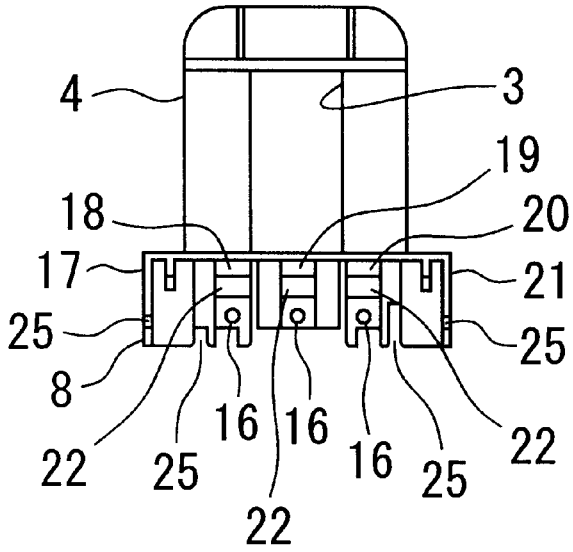
FIG. 2 is a front view showing a coil bobbin of the present invention.
Figure 6:
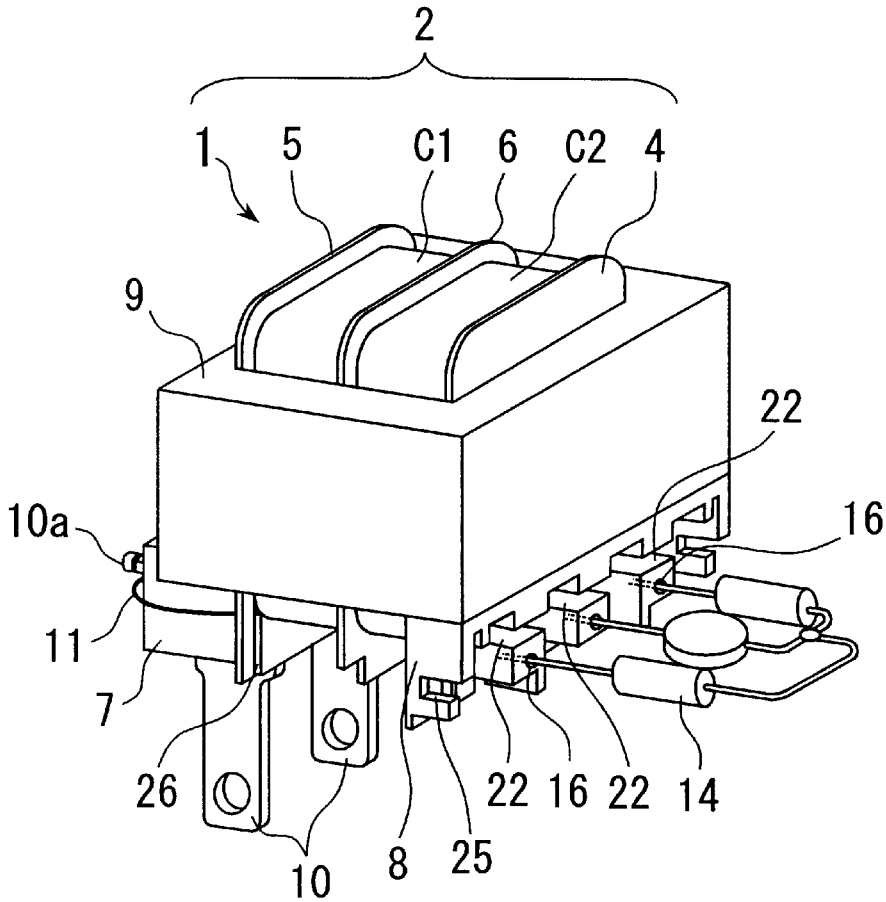
FIG. 6 is a partially perspective view showing a coil bobbin of the present invention to which electronic components are directly attached without using any substrate.

However, the coil bobbin 1 of the present invention does not necessarily need this substrate 15. That is, as shown in FIG. 2, electronic components attaching cavities 16 are formed in the substrate or electronic components attaching portion 8 in the lower portion of the flange 4. With this portion, various kinds of electronic components 14 can be directly attached thereto as shown in FIG. 6.

Next, the configuration of the substrate or electronic components attaching portion 8 will be described in detail. As shown in FIG. 2, on the substrate 15 or electronic components attaching portion 8 in the lower portion of the flange 4, a plurality of first through fifth ribs numbered as 17 through 21 outward projecting in the width direction of the flange 4 with intervals are disposed. These first through fifth ribs numbered 17 through 21 are formed in the prismatic, and grooves 22 are respectively formed in the second through fourth ribs numbered as 18 through 20 which are positioned inside among them. To these grooves 22 to which the substrate 15 is attached, as shown in FIG. 1, the internal end portions of the substrate 15 comprising electronic components 14 are inserted and the substrate 15 is fixed, such as by using an adhesive, etc./as needed.

Incidentally, the number of the ribs 18 through 20 can be appropriately increased or decreased as needed. A leader line 23 of the secondary coil C2 is lead out and connected to an input terminal 24 of a rectifying circuit disposed on the rear side of the substrate 15 via a leader groove 25 which is appropriately formed in the lower portion of the substrate or electronic components attaching portion 8.

In FIG. 1, other members numbered as 27 and 28 are codes and a plug respectively. In addition, in FIG. 4, the substrate 15, the core 9, and the coils C1 and C2 are indicated by virtual lines.

Figure 4:
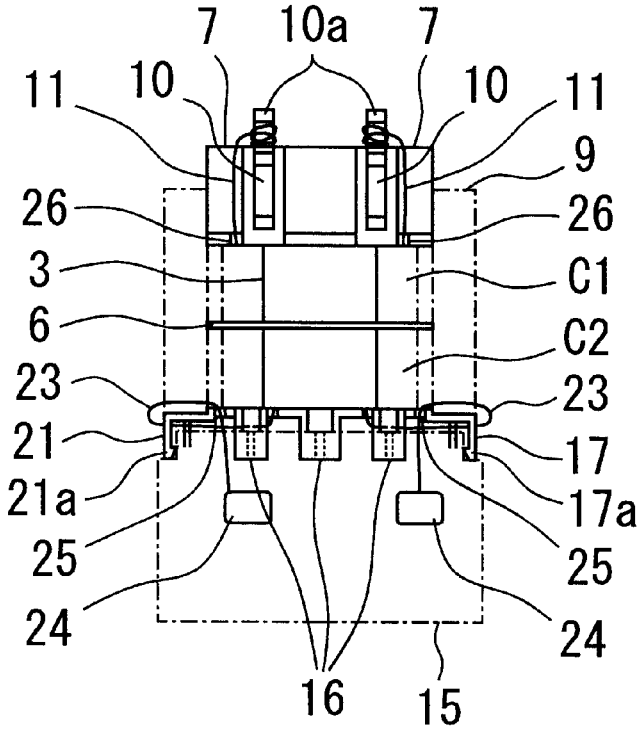
FIG. 4 is a side view showing the coil bobbin of the present invention.

Basically, the substrate 15 is, as aforementioned, attached to the groove 22 by inserting the end of the substrate 15 into the groove 22 for attaching the substrate, but as shown in FIG. 4, there are notches, which are nearly rectangular, at both ends inside the substrate 15, and these notches are arranged so that they can also engage with the hooks 17*a* and 21*a* formed inside the tips of the first and the fifth ribs 17 and 21 for attachment at the time of insertion.

In addition, as shown in FIG. 2, under the grooves 22 for substrates to be attached which are formed in the second rib 18 through the forth rib 20 are respectively formed inside between the first rib 17 and the fifth rib 21 at the both ends, cavities 16 to which the lead terminals of electronic components 14 are inserted for attachment.

Figure 7:
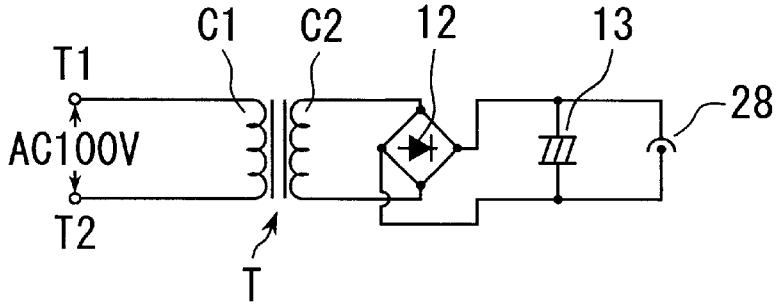
FIG. 7 is a circuit example of an AC adapter which is conventionally available.
Figure 8:
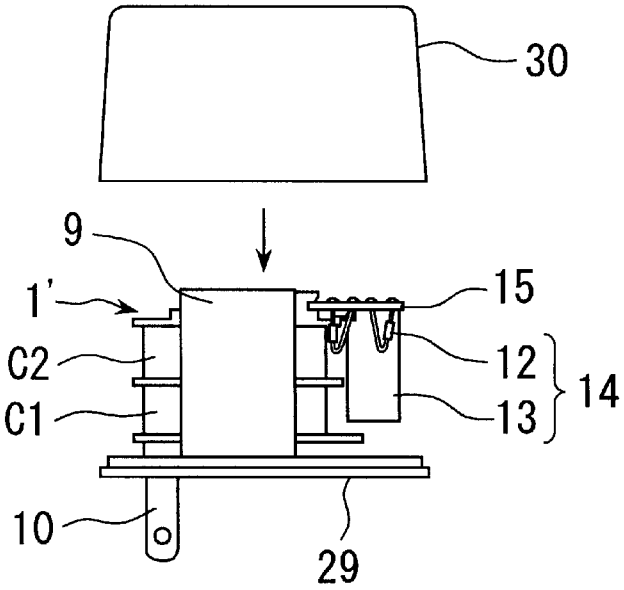
PRIOR ART FIG. 8
FIG. 8 is an exploded perspective view showing a conventional AC adapter.

By utilizing these, without using any substrate 15, but these cavities 16 for electronic components to be attached can be used as shown in FIG. 6, so that respective electronic components 14 may be directly connected with the flange 4 of the coil bobbin 1, and the electronic components 14 are directly and appropriately connected to each other, and consequently a rectifying circuit as shown in FIG. 7, for example, may be configured in the output side of the secondary coil C2.

Incidentally, the cavities 16 for electronic components to be attached which are formed in the ribs 18 through 20 are as shown in FIG. 4 through-holes which go through from outside to inside, and can connect leader lines of electronic components 14 respectively insert-communicated from outside of through holes and drawn out to inside each other so as to configure a desired electronic circuit inside.

Figure 3:
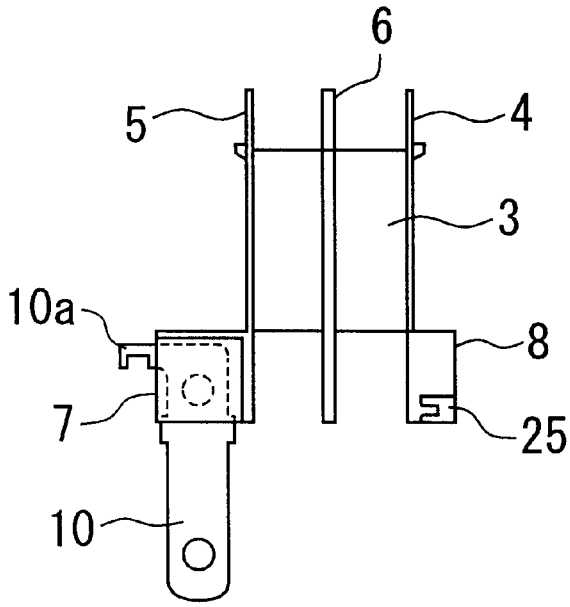
FIG. 3 is a side view showing the coil bobbin of the present invention.
Figure 5:
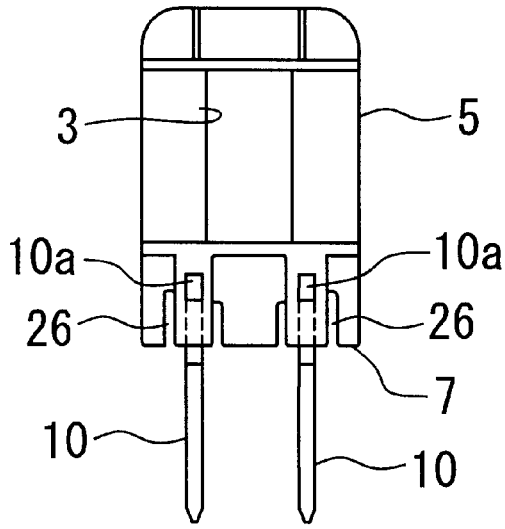
FIG. 5 is a rear view showing the coil bobbin of the present invention.

In addition, as shown in FIG. 3 through FIG. 5, the base portions of a pair of AC blades 10 are laid under the portion for the AC blade to be attached 7 which are formed in the lower part of the flange 5. In addition, as shown in FIG. 1 and FIG. 4, the leader line 11 at the input side of the primary coil C1 shown by virtual lines is drawn out to outside utilizing or otherwise a leader groove 26 appropriately formed in an appropriate position in the bottom portion of the portion for the AC blade to be attached 7, is tied up onto the leader line connecting portion 10*a* formed in the AC blade 10, and undergoes a soldered connection.

As described so far, according to the present invention, the grooves for substrate to be attached thereto 22 as well as the cavities for electronic components to be attached thereto 16 are formed in one flange 4, and thus any of them can be selected as the necessity arises and electronic components 14 can be directly attached to the flange 4 of the coil bobbin 1 without using any AC adapter or any substrate of a substrate-attaching type comprising electronic components 14. And, in the latter case, the substrate 15 will be no longer necessary, which can result in reduction in the number of components, and can make miniaturization achievable.

The invention is clearly new and useful. Moreover, it was not obvious to those of ordinary skill in this art at the time it was made, in view of the prior art considered as a whole as required by law.

It will thus be seen that the objects set forth above, and those made apparent from the foregoing description, are efficiently attained and since certain changes may be made in the above construction without departing from the scope of the invention, it is intended that all matters contained in the foregoing construction or shown in the accompanying drawings shall be interpreted as illustrative and not in the limiting sense.

It is also to be understood that the following claims are intended to cover all of the generic and specific features of the invention herein described, and all statements of the scope of the invention which, as a matter of language, might be said to fall therebetween.

Now that the invention has been described.

What is claimed is:

1. A coil bobbin for an AC adapter comprising:

two flanges formed at both ends of a winding drum and coils being wound around the winding drum;

an electronic circuit disposed in one of said flanges;

a pair of terminal blades disposed in the other flange;

a core surrounding the two flanges and the coils; and an attaching portion formed on a lower portion of said one of the flanges, wherein grooves are formed in a first row in the attaching portion so that an edge portion of a substrate is insertable in said grooves, the grooves being means for mounting the substrate with first electronic components configuring said electronic circuit mounted thereon, wherein cavities are formed in a second row below the first row of the attaching portion, the cavities being another means for directly mounting second electronic components by inserting lead terminals of the second electronic components into the cavities, wherein the electronic circuit is a rectifying circuit converting an alternate current to a direct current, and wherein the attaching portion can either directly receive the edge portion of the substrate with the first electronic components mounted thereon into the grooves, or the lead terminals from the second electronic components can be directly inserted into the cavities.

2. The coil bobbin according to claim 1, wherein the attaching portion comprises a first rib through a fifth rib, all ribs being spaced-apart and protruding away from said one of the flanges in a direction opposite of the other flange, wherein said grooves which are formed in a second rib through a fourth rib, the second through fourth ribs being positioned between the first rib and fifth rib for engaging with the edge portion of the substrate.

3. The coil bobbin according to claim 2, wherein leader grooves are formed in the first rib through fifth rib, the leader grooves for running leader lines of a secondary coil to the substrate, wherein the leader grooves are formed in other portions of said one of said flanges, wherein said secondary coil is wound around an outer periphery of a hollow winding drum portion of the coil bobbin, wherein a primary coil and the secondary coil are separately wound by an intermediate flange positioned between the two flanges, and wherein said primary coil is connected to the blade terminals, the blade terminals for insertion into an AC plug socket, and said secondary coil is connected to said one of the flanges by the leader lines running through the leader grooves.

4. The coil bobbin according to claim 3, wherein hook portions are formed in the first rib and the fifth rib for locking with notches formed on both sides of the edge portion of the substrate.

* * * * *

UNITED STATES PATENT AND TRADEMARK OFFICE
CERTIFICATE OF CORRECTION

PATENT NO : 6,162,067
DATED : December 19, 2000
INVENTOR(S) : Yuji HAGA

It is certified that error appears in the above-identified patent and that said Letters Patent is hereby corrected as shown below:

On title page, item 30 Foreign Applciation Priority Data
replace "Oct. 2, 1999"
with --Feb. 10, 1999--.

Signed and Sealed this

Twenty-second Day of May, 2001

Nicholas P. Godici

*Attest:*

NICHOLAS P. GODICI

*Attesting Officer*

*Acting Director of the United States Patent and Trademark Office*